United States Patent [19]

Smithbauer et al.

[11] Patent Number: 4,527,470

[45] Date of Patent: Jul. 9, 1985

[54] PULLEY FOR BAND PRINTERS

[75] Inventors: Donald J. Smithbauer, Thousand Oaks; Daniel R. Lytle, Canoga Park; Clifford Helms, Westlake Village, all of Calif.

[73] Assignee: Dataproducts Corporation, Woodland Hills, Calif.

[21] Appl. No.: 684,744

[22] Filed: Dec. 20, 1984

Related U.S. Application Data

[63] Continuation of Ser. No. 230,867, Feb. 2, 1981, abandoned.

[51] Int. Cl.[3] ..... F16H 55/36; B41J 1/20; B41J 1/60

[52] U.S. Cl. ..... 101/111; 474/189; 474/184; 474/187; 400/146

[58] Field of Search ..... 474/184, 187, 188, 189, 474/122, 119, 101; 400/146; 101/111

[56] References Cited

U.S. PATENT DOCUMENTS

| | | | |
|---|---|---|---|
| 1,560,524 | 11/1925 | Avery | 474/189 |
| 2,338,414 | 1/1944 | DeSart, Sr. et al. | 474/123 |
| 2,423,407 | 7/1947 | Searles et al. | 474/187 |
| 2,592,581 | 4/1952 | Lorig | 474/187 |
| 2,727,400 | 12/1955 | Lorig | 474/187 |
| 3,029,657 | 4/1962 | Roper | 474/187 |
| 3,196,701 | 7/1965 | Morrow | 474/189 |
| 3,744,329 | 7/1973 | Frank | 474/187 |
| 3,772,931 | 11/1973 | Conrad et al. | 474/189 |
| 3,961,736 | 6/1976 | Fatula | 474/189 |
| 4,301,725 | 11/1981 | Hiki et al. | 101/111 |

OTHER PUBLICATIONS

IBM Technical Disclosure Bulletin, vol. 15, No. 4, Sep. 1972, p. 1234; O. R. Iobst et al.

"Theory and Application of Lorig-Aligner Self-Centering Rolls" Manufactured by Standard Rubber Company, Inc., pp. 1-30.

*Primary Examiner*—Lawrence J. Staab
*Assistant Examiner*—Michael D. Bednarek
*Attorney, Agent, or Firm*—Spensley Horn Jubas & Lubitz

[57] ABSTRACT

An improved pulley system for use with band printers or the like. A steel printing band is looped around a pair of capstans covered by sleeves made of elastomeric material. The sleeves include a plurality of downwardly angled flexible circumferential flanges and a lower horizontal rim. The band contacts the flanges and as the capstans rotate, inward force on the band is transferred to a downward force by means of the flanges. The downward force causes the band to move into contact with the lower horizontal rim, thereby vertically aligning the band in the printer. In an alternate embodiment, a plurality of non-flexible circumferential ridges are included. The central ridges extend farther out from the surface of the sleeve and serve to define a crown. The sleeve configuration serves to reduce wear and accurately align the printing band within the printer assembly.

13 Claims, 8 Drawing Figures

PULLEY FOR BAND PRINTERS

This is a continuation of copending application Ser. No. 230,867 filed on Feb. 2, 1981 now abandoned.

BACKGROUND OF THE INVENTION

1. Field of the Invention

This invention relates to band printers in which a steel printing band containing type characters if formed into a loop around a pair of pulleys. The pulleys are rotated in order to move the band and present different characters to a printing medium. More particularly, this invention relates to an improved pulley for use with such band printers.

2. Description of the Prior Art

In band printers, a critical requirement is that the band be maintained in proper vertical alignment so as to achieve accurate print registration on the printing medium. One method of providing band alignment in pulley systems involves the use of crowned pulleys, as shown in FIG. 2. A crowned pulley (i.e., one in which the middle of the pulley surface extends beyond its edge) provides a self centering action on a band by causing the center of the band to align with the top of the crown. Such a system cannot successfully be used with band printers because variations in the thickness of the band (due both to inconsistencies in the band itself and the non-uniformity of etched print characters) would cause the true, or elastic, center of the band to vary, resulting in a slight amount of "floating" of the band. This floating would result in completely unacceptable performance if a system if this type were used in a band printer.

A commonly utilized prior art band printer pulley design is shown in FIG. 3. In this type of design, the pulleys which carry the band have a slanted outer surface. The printing band is looped around a pair of pulleys having parallel axes. The slanting surface of the outer shell causes the tensioned band to move downward and contact a pair of steel roller bearings 34 as it is moved around the pulleys. The roller bearings serve to maintain the band in a fixed vertical position. Although the bearings are made of steel, the motion and sharpness of the steel band causes grooves to be slowly cut into the bearings. Since the bearings establish the vertical alignment of the printing band, the gradual formation of the groove will eventually cause the band to become misaligned, resulting in misregistration during printing. The pulleys can either be maintained in a fixed vertical position or can be mounted so as to allow free vertical movement. In the latter instance, the weight of the pulley is the only downward force acting upon the band, and the force on the bearings is somewhat reduced. However, the use of such a pulley mounting does not completely eliminate the problem of groove formation.

It is accordingly an object of the present invention to provide a pulley which provides accurate long term vertical positioning of the printer band. It is a further object of the present invention to provide a pulley which is low in cost and maintains its performance despite variations in environmental conditions such as humidity.

SUMMARY OF THE INVENTION

The pulley of the present invention is comprised of a sleeve made of a flexible material which is designed to fit tightly around a high inertia capstan. The sleeve, which may be either one or two piece, includes a plurality of downwardly angled flanges which extend from the wall of the sleeve. A horizontal rim extends from the bottom of the sleeve. A steel printing band is looped around the capstans and sleeves and is held in tension. The flanges are somewhat flexible, and rotation of the capstans creates an inward force which is translated into a downward force by the flanges. The downward force causes the band to move down the sleeve until it contacts the horizontal rim. The combination of the downward force created by the flanges and the horizontal rim serves to accurately vertically position the printing band within the printer. The rim contacts and supports the band over a relatively large area, thereby minimizing wear and maintaining vertical alignment. The operation of the pulley may be enhanced by providing, in addition to the flexible flanges, a plurality of relatively inflexible protrusions on the surface of the pulley to simulate a crown. A pulley of this type is less prone to humidity and temperature variations than is the pulley which uses only angled flanges.

DESCRIPTION OF THE PREFERRED EMBODIMENTS

Figure 1:
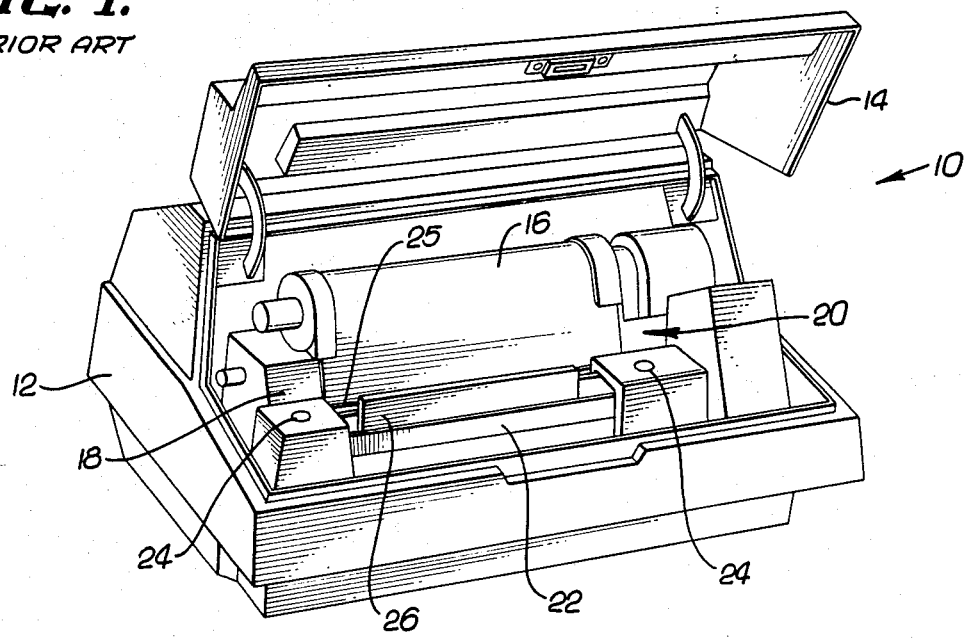
FIG. 1. PRIOR ART
FIG. 1 is a perspective view of a typical band printer which utilizes the present invention.

FIG. 1 shows a typical band printer 10 which may be used, for example, as a computer output printer. The printer includes a housing 12 having a lift-up cover 14. A printing medium such as paper 16 is transported past a print hammer assembly 18 by a transport mechanism 20. A steel character band 22 is looped around a pair of pulleys 24, one of which is motor driven to move the band 22. A ribbon 25 is located between the medium and the band, and a platen 26 is located at the opposite side of the band from the ribbon. The band 22 contains a raised type font and in order to print the hammers of the hammer assembly 18 impact against the paper to force it into contact with the ribbon and moving band.

Figure 2:
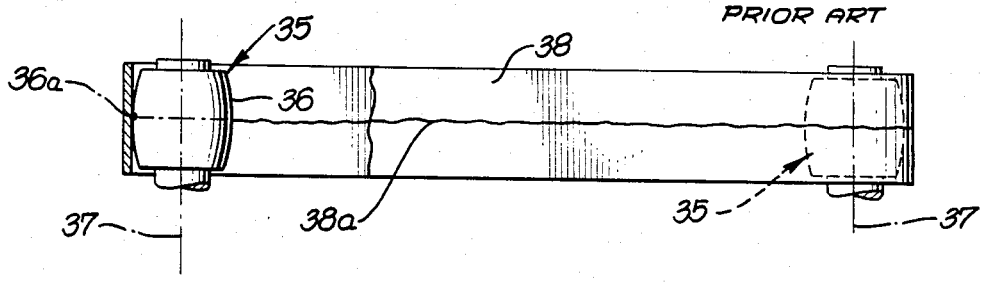
FIG. 2. PRIOR ART
FIG. 2 is a front plan view of a pulley system showing a crowned pulley.

A typical crowned pulley system is shown in FIG. 2. The system includes pulleys 35 which have a convex outer surface 36. The pulleys rotate about axes 37, and forces created as a belt 38 moves around the pulleys cause the actual center of the band by weight 38*a* (elastic center) to align itself with the top 36*a* of the crowned surface 36. The self-centering action alone of the crowned pulley is not sufficient for use with band printers since variations in the position of the elastic center of the band will cause the band to "float" by a small amount.

Figure 3:
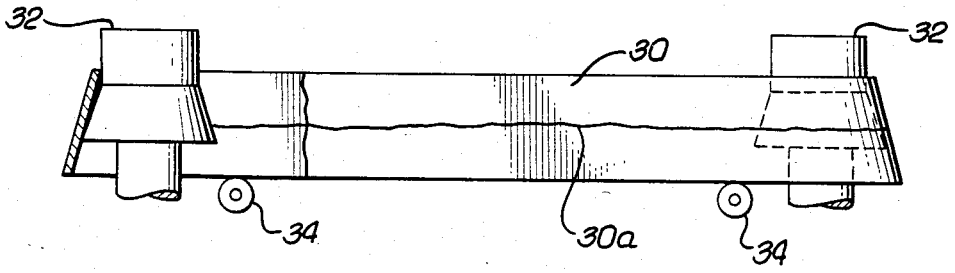
FIG. 3. PRIOR ART
FIG. 3 is a front plan view of one type of prior art band and pulley mechanism.

Referring to FIG. 3, a typical prior art arrangement for use with band printers is shown. The system includes a steel printing band 30 which is looped around a pair of metal capstans 32, the surfaces of which taper outwardly toward their lower ends. When the capstans 32 are rotating and the band 30 is moving, the tapering surfaces cause the band to creep downward so as to tend to align the center 30*a* of the band with the protruding lower edge of the capstans 32. This tendency is due to a crown effect provided by the slanted surface of the capstans. The band 30 will move down until its lower edge contacts a steel roller bearing 34 associated with each capstan. The bearings 34 are positioned so that when they are contacted by the band 30, the band is in proper vertical alignment in the printer. However, because of the extremely small contact area between the band and the bearings 34, immense pressure is exerted on the bearings and a groove tends to be gradually cut into their surfaces. This is so despite the fact that the bearings are made of steel. In addition, the slanted surface of the capstan cause the band to bow or flex somewhat, which speeds up wear on the bearings and can also cause portions of the band to scrape against the platen. As the depth of the groove increases, the accuracy of the vertical alignment of the band 30 decreases, eventually resulting in unacceptable misregistration.

If band properties and operating conditions were constant, the tension on the band could be maintained at a value which would keep the downward force on the band (and thus the bearings) at a very low level. However, the tension must be sufficient to keep the band in contact with the bearings despite changes in environmental conditions such as temperature, humitidy, etc. Because of this, band tension is maintained at a value which will keep the band in contact with the bearings even in a worst case situation. This higher tension futher increases the wear on the bearings.

Figure 4:
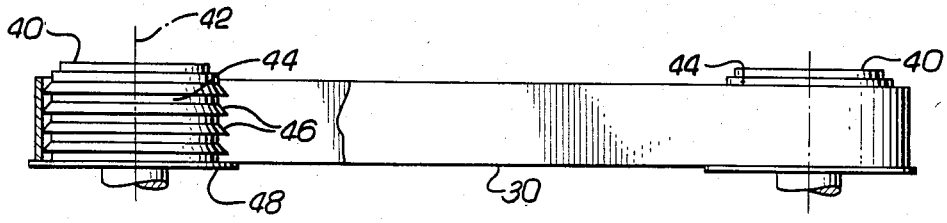
FIG. 4 is a front plan view of the band and pulley mechanism of the present invention.
Figure 5:
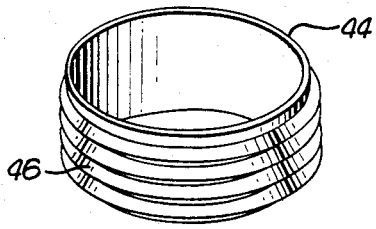
FIG. 5 is a perspective view of the pulley sleeve of the present invention.
Figure 6:
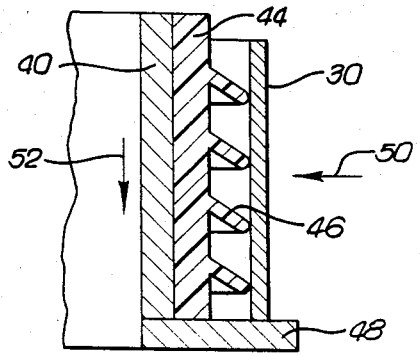
FIG. 6 is a plan view in section showing the forces acting upon the printing band and sleeve.

Referring now to FIGS. 4–6, one embodiment of the pulley assembly of the present invention includes a pair of cylindrical high inertia capstans 40 having longitudinal axes 42. The capstans 40 provide high mass which facilitates constant rotational velocity and thus accurate position with respect to time of the band 30. Surrounding each capstan 40 is an elastomeric sleeve 44 which includes a plurality (four in the embodiment shown) of integrally formed downwardly angled flanges 46. An horizontal rim 48 extends around the bottom of the sleeve 44. The rim may be formed integrally with the sleeve 44 or may be made of a separate material.

During operation of the pulley system shown in FIG. 4 the belt 30 is held in tension against the flanges 46. When the capstans 40 are rotated, thereby moving the belt 30, the inward tension force on the belt 30 (shown by arrow 50 in FIG. 6) is translated into a downward force (shown by arrow 52) by means of the downwardly angled, somewhat resilient flanges 46. This downward force causes the belt 30 to move or creep down the flanges 46 until its lower edge contacts the horizontal rim 48. Since the rim 48 extends completely around the sleeve 44, the downward force on the band 30 is spread over a significantly larger area than is the case in the prior art designs. Because of these factors, the tendency to wear a groove into the rim 48 is very slight. In addition, there is no bowing of the band, thus further reducing wear and eliminating any scraping against the platen. The vertical alignment of the band 30 will therefore remain accurate over a long period of time.

Figure 7:
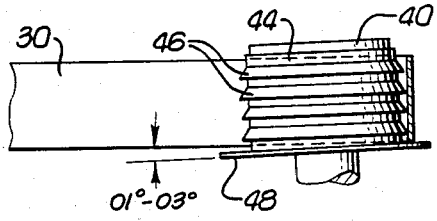
FIG. 7 is a plan view showing a tilted pulley mechanism utilized to further minimize wear.
Figure 8:
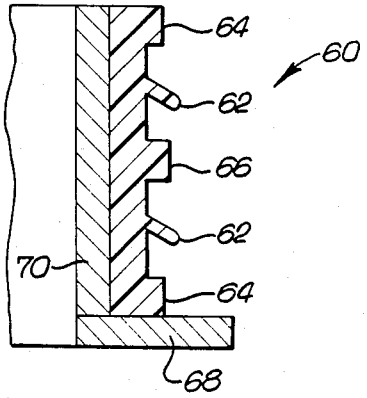
FIG. 8 is a plan view in section of an alternate sleeve configuration.

The use of a sleeve having a lower rim presents an additional wear problem over and above that of downward pressure. When the axes 42 of the capstans 40 are maintained parallel to one another, there is a slight tendency of the band 30 to scuff or scrape the rim 48 at its initial point of contact. This problem can be alleviated by the arrangement shown in FIG. 7. In the design of FIG. 7, the axes 42 of the capstans 40 are both tilted inward slightly so that the tops of the capstans are closer together than are the bottoms. The angle of tilt is very slight; on the order of 0.1 to 0.3 degrees. The tilt serves to prevent the bottom of the band 30 from contacting the rim 48 until it also contacts the flanges 46, thus eliminating scuffing of the rim 48 as the band wraps around the pulleys. It should be noted that the inward tilting of the pulleys causes the band to bend downward somewhat, i.e., to follow the tilt of the pulleys. Because of this, a 1 degree tilt of the pulleys may result in, i.e., only a 0.1 degree angle between the rim and the band. Also, as an alternative to tilting the pulleys, the rim 48 could be angled slightly downward at its outer edge, thereby reducing the amount of scraping as the band wraps onto the sleeve. Of course, the portion of the rim upon which the band rides must be maintained horizontal in order to provide accurate vertical positioning.

The sleeve of FIGS. 4–7 greatly reduces the wear problems associated with the configuration shown in FIG. 3. Studies have indicated, however, the configuration of the flanges is such that the performance of the sleeve 44 may vary with changes in humidity and temperature. As the humidity and temperature increase, the coefficient of friction of the sleeve decreases. If the friction between the band 30 and flanges 46 becomes too low, the downward force which is created may be insufficient to force the band to move down into contact with the rim 48, thereby resulting in misalignment of the band. In order to overcome this potential problem, the tension on the band must be maintained at a sufficiently high level to insure that enough downward force will be created to force the band 30 into contact with the rim despite any variations in humidity and/or temperature. The increase in tension causes an increased amount of stress to be placed upon the printer assembly.

It has been found that optimum performance can be obtained by incorporating aspects of both a crowned pulley system and a flanged pulley system. Referring to FIG. 9, a sleeve 60 which is less sensitive to temperature variations than the design of FIGS. 4–8 includes a pair of angled flexible flanges 62 similar to the flanges 46, a pair of relatively inflexible end ridges 64 and an inflexible center ridge 66. A bottom rim 68 is secured to a capstan 70. The center ridge 66 extends outward slightly farther than the end ridges 64. The ridge 66 therefore acts as a crown, and the elastic center of the band will tend to align itself with the center ridge. The crowned effect provided by the ridges 64 and 66 increases the downward force provided by the sleeve 60, thereby greatly reducing problems caused by humidity and temperature variation and enabling the band to be maintained at a relatively low tension. The flanges 62 function to reduce the bowing of the band, and the combination of the flanges and ridges therefore results in a sleeve which causes minimal scraping and is insensitive to environmental changes. It should be noted that although it is preferred that ridges be utilized to approximate a crown, the use of ridges is not limited to such a function. One or more ridges can be provided on a flanged sleeve to provide a solid radius beyond which the flanges cannot be flexed, thereby serving to control the amount of downward force which can be provided by the flanges.

Many alternate materials can be utilized for the pulley assemblies of the present invention. Various elastomeric materials are suitable for the formation of the sleeve, with a styrene butadiene synthetic rubber (commonly referred to as SBR) being preferred for its strength and relatively stable coefficient of friction. Although the lower rim may formed integrally with the sleeve, a separate rim of steel, hard plastic such as Delrin or other hard material is preferred so as to provide additional wear and scuff resistance over and above that provided by the elastomeric sleeve. In addition, the design and operating conditions of the flanges and ridges could be modified in many ways so as to achieve the proper amount of downward force.

In summary, the present invention provides an improved pulley for use in band printers which provides accurate long term band alignment. Although the invention has been described in terms of several specific embodiments, there are many obvious modifications of the structure, proportions, materials and components without departing from the scope of the invention. Specifically, although the embodiments described are directed to a sleeve for use in conjunction with a high mass capstan, the invention could be employed with any cylindrical surface (e.g., a one piece capstan having a flanged cylindrical surface could be employed instead of a separate sleeve and capstan configuration). The claims are therefore intended to cover all obvious modifications and variations.

We claim:

1. A band printer system comprising:

a pair of pulleys;

a cylindrical sleeve surrounding each pulley, the sleeve including a plurality of flexible downwardly angled flanges extending around the circumference of the sleeve, and a lower rim extending substantially perpendicularly from the bottom of the sleeve, a print band having characters formed thereon, the print band being looped around the pulleys, whereby the print band will be forced downward along said flanges and against said rim; and a printing assembly operating in conjunction with the print band to print characters on a printing medium.

2. A band printer system comprising:

a pair of pulleys, each pulley including a plurality of downwardly angled resilient flanges extending around the circumference thereof, and a substantially horizontal rim extending from the lower edge of said pulley; and a print band having characters formed thereon, the print band being looped around the pulleys, whereby the print band will be forced downward into contact with said rims thereby vertically aligning the band, said flanges preventing any substantial bowing of the print band; and a printing assembly operating in conjunction with the print band to print characters on a printing medium.

3. The system of claim 2 wherein the pulley is comprised of a cylindrical capstan surrounded by a circumferential sleeve, and wherein said flanges are formed on the outer surface of said sleeve.

4. The system of claim 3 wherein the sleeve is made of an elastomeric material.

5. The system of claim 3 wherein said sleeve, flanges and rim are integrally formed.

6. The system of claim 3 wherein said sleeve and flanges are integral and said rim is formed from a separate material which is harder than the sleeve and flange material.

7. The system of claim 3 wherein said sleeve is made of a styrene butadiene synthetic rubber.

8. The system of claim 6 wherein said sleeve and flanges are made of a styrene butadiene synthetic rubber and said rim is made of steel.

9. The system of claim 3 wherein the sleeve further includes at least one circumferential ridge on the surface of the sleeve.

10. The system of claim 9 wherein the sleeve further includes a central ridge and two end ridges, wherein the central ridge extends outward further than the end ridges to thereby define a crown.

11. A band printer system comprising:

a pair of spaced generally parallel capstans;

a pulley sleeve circumferentially surrounding each capstan;

a plurality of downwardly angled flanges extending around the circumference of each pulley sleeve;

a generally horizontal rim extending from the lower edge of each pulley sleeve;

a print band having characters formed thereon looped around said pulley sleeves whereby rotation of the capstans will cause the band to compress the flanges and move downward into contact with the rims, thereby accurately vertically positioning the band; and a printing assembly operating in conjunction with the print band to print characters on a printing medium.

12. The band printer system of claim 11 wherein the rotational axes of said capstans are slanted toward one another so that their tops are closer together than their bottoms, thereby reducing scuffing between the print band and the rims.

13. The band printer system of claim 11 wherein said horizontal rim is separate from said sleeve and is non-rotatable, wherein each rim is tilted downward in the direction of the other rim, thereby reducing scuffing between the band and the rims.

* * * * *